US006560989B1

(12) United States Patent
Roberts et al.

(10) Patent No.: US 6,560,989 B1
(45) Date of Patent: May 13, 2003

(54) SEPARATION OF HYDROGEN-HYDROCARBON GAS MIXTURES USING CLOSED-LOOP GAS EXPANDER REFRIGERATION

(75) Inventors: Mark Julian Roberts, Kempton, PA (US); Christopher Francis Harris, Old Zionsville, PA (US); Christopher Michael Ott, Barto, PA (US); Howard Charles Rowles, Center Valley, PA (US); Daniel Lewis Longhurst, Morden (GB); Brian Alfred McNeil, Hook (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/165,654

(22) Filed: Jun. 7, 2002

(51) Int. Cl.[7] ..... F25J 3/00
(52) U.S. Cl. ..... 62/623; 62/912; 62/932
(58) Field of Search ..... 62/617, 618, 623, 62/912, 932

(56) References Cited

U.S. PATENT DOCUMENTS

| | | | | |
|---|---|---|---|---|
| 4,256,476 | A | 3/1981 | Van Baush | 62/23 |
| 4,559,069 | A | 12/1985 | Becker | 62/11 |
| 4,629,484 | A | 12/1986 | Kister | 62/29 |
| 4,749,393 | A | 6/1988 | Rowles et al. | 62/24 |
| 5,333,462 | A | 8/1994 | Garot et al. | 62/24 |
| 5,414,168 | A | 5/1995 | Scott | 585/2 |
| 5,421,167 | A | 6/1995 | Verma | 62/24 |
| 5,452,581 | A | 9/1995 | Dinh et al. | 62/24 |
| 5,626,034 | A | 5/1997 | Manley et al. | 62/623 |
| 5,979,177 | A | 11/1999 | Sumner et al. | 62/612 |
| 6,041,620 | A | 3/2000 | Olszewski et al. | 62/612 |
| 6,041,621 | A | 3/2000 | Olszewski et al. | 62/613 |
| 6,266,977 | B1 | 7/2001 | Howard et al. | 62/623 |

FOREIGN PATENT DOCUMENTS

| | | | |
|---|---|---|---|
| DE | 2440215 | 3/1976 | F25J/1/00 |
| WO | WO 9527179 | 10/1995 | F25J/1/02 |
| WO | WO 9713109 | 4/1997 | F25J/1/02 |

*Primary Examiner*—Denise L. Esquivel
*Assistant Examiner*—Malik N. Drake
(74) *Attorney, Agent, or Firm*—John M. Fernbacher

(57) ABSTRACT

A method for the recovery of hydrogen and one or more hydrocarbons having one or more carbon atoms from a feed gas containing hydrogen and the one or more hydrocarbons, which process comprises cooling and partially condensing the feed gas to provide a partially condensed feed; separating the partially condensed feed to provide a first liquid stream enriched in the one or more hydrocarbons and a first vapor stream enriched in hydrogen; further cooling and partially condensing the first vapor stream to provide an intermediate two-phase stream; and separating the intermediate two-phase stream to yield a further-enriched hydrogen stream and a hydrogen-depleted residual hydrocarbon stream. Some or all of the cooling is provided by indirect heat exchange with cold gas refrigerant generated in a closed-loop gas expander refrigeration cycle.

27 Claims, 3 Drawing Sheets

SEPARATION OF HYDROGEN-HYDROCARBON GAS MIXTURES USING CLOSED-LOOP GAS EXPANDER REFRIGERATION

BACKGROUND OF THE INVENTION

The separation of gas mixtures containing hydrogen and light hydrocarbons is an important and widely-used operation in the refining and petrochemical industries. Many of these gas mixtures contain hydrogen, methane, major amounts of ethane and propane, and lower amounts of heavier saturated hydrocarbons. The recovery of hydrogen from such gas mixtures is an economically important operation in the refining industry. Other gas mixtures, for example gas mixtures produced by steam pyrolysis of saturated hydrocarbons, contain hydrogen, methane, and unsaturated hydrocarbons including ethylene and propylene. The recovery of ethylene and propylene from these mixtures is a large and economically important segment of the petrochemical industry. It is desirable in many cases to recover product quality hydrogen along with the main ethylene and propylene products. The recovery of methane-rich fuel gas also may be desirable.

The separation of these gas mixtures is usually accomplished by cryogenic condensation and fractionation methods, which require large amounts of refrigeration at low temperatures. Many methods have been proposed to provide this refrigeration for the recovery of $C_2$ or $C_3$ and heavier hydrocarbons in combination with an upgraded hydrogen product stream. These methods include work expansion of the upgraded hydrogen product gas, refrigeration systems using mixed refrigerants, conventional vapor compression refrigeration systems, Joule-Thomson expansion refrigeration, and various combinations of these refrigeration systems. Other processes utilize absorption for the recovery of $C_2$ or $C_3$ and heavier hydrocarbons and for the removal of light hydrocarbon impurities from the hydrogen product stream.

U.S. Pat. No. 5,979,177 describes a process utilizing a binary mixed refrigerant refrigeration system to recover ethylene and hydrogen from cracked gas in an ethylene plant. U.S. Pat. No. 5,626,034 describes a process utilizing two mixed refrigerant refrigeration systems to recover ethylene and hydrogen from cracked gas. However, most ethylene plants utilize cascaded vapor compression-type ethylene and propylene refrigeration systems supplemented with fuel gas expanders to recover ethylene and hydrogen as described in U.S. Pat. Nos. 5,452,581, 5,421,167 and 4,629,484.

A cold absorption process is described in U.S. Pat. No. 5,414,168 which utilizes an internally generated hydrocarbon stream as a solvent with work expansion of the upgraded hydrogen product gas to provide refrigeration for recovery of olefinic hydrocarbons and purified hydrogen from a catalytic dehydrogenation unit effluent gas stream. Another cold absorption process is disclosed in U.S. Pat. No. 5,333,462 which utilizes Joule-Thomson expansion of the separated hydrocarbon liquids to provide refrigeration for recovering heavy hydrocarbons and hydrogen from catalytic cracking off-gas and an auxiliary gas, which is partially condensed to provide the absorption solvent.

U.S. Pat. No. 4,256,476 discloses a process utilizing only Joule-Thomson expansion of the separated hydrocarbon liquids to recover ethane and hydrogen from thermal hydrocracking off-gases. U.S. Pat. No. 4,749,393 describes a cryogenic process utilizing work expansion of the upgraded hydrogen product gas and Joule-Thomson expansion of the separated hydrocarbon liquids to provide refrigeration for recovery of heavy hydrocarbons and hydrogen from hydrogen-lean feed gases. U.S. Pat. No. 4,559,069 describes a multistage fractional condensation process utilizing Joule-Thomson expansion of the separated hydrocarbon liquids and auxiliary vapor compression-type $C_2$ and $C_3$ refrigeration units to recover hydrogen and heavy hydrocarbons from multiple feed streams.

U.S. Pat. No. 6,266,977 describes a process to recover $C_2$ or $C_3$ and heavier hydrocarbons, including ethylene and/or propylene, utilizing a closed-loop gas expander refrigeration system but does not address the recovery of an upgraded hydrogen product stream or a methane-rich product stream.

Gas expander refrigeration systems of the open-loop and closed-loop type, including some which use nitrogen as the refrigerant, are described for use in hydrocarbon gas liquefaction processes in U.S. Pat. Nos. 6,041,620, 6,041,621, and 6,308,531; PCT Applications WO 95/27179 and WO 97/13109; and German Patent 24 40 215.

There is a need in the refining and petrochemical industries for improved refrigeration methods for the recovery of $C_2$ or $C_3$ hydrocarbons in combination with the recovery of hydrogen, particularly at warmer temperature levels of −50° F. to −300° F. The present invention, as described below and defined by the claims which follow, addresses this need with several closed-loop gas expander refrigeration systems for recovering $C_2$ or $C_3$ hydrocarbons, hydrogen, and optionally methane from hydrogen-hydrocarbon mixtures.

BRIEF SUMMARY OF THE INVENTION

The invention relates to a method for the recovery of hydrogen and one or more hydrocarbons having one or more carbon atoms from a feed gas containing hydrogen and the one or more hydrocarbons, which process comprises (a) cooling and partially condensing the feed gas to provide a partially condensed feed; (b) separating the partially condensed feed to provide a first liquid stream enriched in the one or more hydrocarbons and a first vapor stream enriched in hydrogen; (c) further cooling and partially condensing the first vapor stream to provide an intermediate two-phase stream; and (d) separating the intermediate two-phase stream to yield a further-enriched hydrogen stream and a hydrogen-depleted residual hydrocarbon stream. Some or all of the cooling in (a), or in (c), or in (a) and (c) is provided by indirect heat exchange with cold gas refrigerant generated in a closed-loop gas expander refrigeration cycle.

The cooling in (a) may be effected in a first heat exchange zone and the further cooling in (c) may be effected in a second heat exchange zone. The method may further comprise introducing the first liquid stream into a stripping column, and withdrawing therefrom a liquid stream further enriched in the one or more hydrocarbons and a residual vapor stream comprising hydrogen and portions of the one or more hydrocarbons.

The method may further comprise reducing the pressure of the hydrogen-depleted residual hydrocarbon stream of (d) to yield a reduced-pressure residual hydrocarbon stream and warming the reduced-pressure residual hydrocarbon stream in the second heat exchange zone by indirect heat exchange with the first vapor stream enriched in hydrogen to provide a portion of the cooling in (c), thereby providing a warmed residual hydrocarbon stream. The method may further comprise combining the residual vapor stream from the stripping column and the warmed residual hydrocarbon stream from the second heat exchange zone to provide a combined residual stream, and warming the combined residual stream by indirect heat exchange with the feed gas in the first heat exchange zone, thereby providing a portion of the cooling of the feed gas in (a).

The cold gas refrigerant generated in the closed-loop gas expander refrigeration cycle may provide cooling in the first and second heat exchange zones by the steps of (1) compressing and cooling a refrigerant gas to provide a cooled compressed refrigerant gas and dividing the cooled compressed refrigerant gas into a first and a second cooled refrigerant gas stream;

(2) work expanding the first cooled refrigerant gas stream to provided a cooled work-expanded refrigerant gas stream;

(3) further cooling and reducing the pressure of the second cooled refrigerant gas stream to provide a cooled reduced-pressure refrigerant gas stream, wherein reducing the pressure is effected by either work expansion or Joule-Thomson expansion across a throttling valve;

(4) warming the cooled reduced-pressure refrigerant gas stream in the second heat exchange zone to provide at least a portion of the cooling of the first vapor stream in (c), thereby providing a warmed reduced-pressure refrigerant gas stream; and (5) combining the cooled work-expanded refrigerant gas stream of (2) and the warmed reduced-pressure refrigerant gas stream of (4) to provide a combined reduced-pressure refrigerant gas stream and warming the combined reduced-pressure refrigerant gas stream in the first heat exchange zone to provide at least a portion of the cooling of the feed gas in (a), thereby warming the combined reduced-pressure refrigerant gas stream to provide the refrigerant gas of (1).

The refrigerant gas may be selected from the group consisting of nitrogen, methane, a mixture of nitrogen and methane, and air.

The method may further comprise warming the further-enriched hydrogen stream of (d) in the first and second heat exchange zones to provide by indirect heat exchange a portion of the cooling of the feed gas in (a) and a portion of the cooling of the first vapor stream in (c).

The cooling in (a) and (c) may be effected in a first heat exchange zone and the method may further comprise introducing the first liquid stream of (b) into a distillation column and withdrawing therefrom a liquid stream enriched in hydrocarbons containing two or more carbon atoms and a residual vapor stream enriched in methane. The intermediate two-phase stream of (c) may be introduced into the distillation column.

The method may further comprise warming the residual vapor stream in the first heat exchange zone to provide by indirect heat exchange at least a portion of the cooling of the feed gas in (a). The method also may further comprise cooling and partially condensing the further-enriched hydrogen stream of (d) in a second heat exchange zone to provide an additional intermediate two-phase stream, and separating the additional intermediate two-phase stream to yield a hydrogen product stream and an additional hydrogen-depleted residual hydrocarbon stream. In addition, the hydrogen product stream may be warmed in the first and second heat exchange zones to provide by indirect heat exchange a portion of the cooling of the feed gas in (a) and a portion of the cooling of the further-enriched hydrogen stream.

The method may further comprise reducing the pressure of the additional hydrogen-depleted residual hydrocarbon liquid stream to yield a reduced-pressure residual hydrocarbon liquid stream, warming the reduced-pressure residual hydrocarbon liquid stream in the second heat exchange zone to yield a two-phase residual hydrocarbon liquid stream, separating the two-phase residual hydrocarbon stream to yield a residual hydrocarbon vapor stream and an enriched hydrocarbon liquid stream, and introducing the enriched hydrocarbon liquid stream into the distillation column as reflux. In addition, the residual hydrocarbon vapor stream may be warmed in the first heat exchange zone to provide a portion of the cooling of the feed gas in (a).

A portion of the feed gas stream may be cooled by indirect heat exchange with one or more hydrocarbon-rich liquid streams withdrawn from a lower part of the distillation column to provide a cooled feed stream and one or more vaporized hydrocarbon-rich streams, the one or more vaporized hydrocarbon-rich streams may be returned to the distillation column to provide boil-up therein, and the cooled feed stream may be combined with the partially condensed feed of (a).

The cold gas refrigerant generated in the closed-loop work expander refrigeration cycle may provide cooling in the first and second heat exchange zones by the steps of (1) providing a compressed refrigerant gas, cooling the compressed refrigerant gas to provide a cooled compressed refrigerant gas, and dividing the cooled compressed refrigerant gas into a first and a second cooled refrigerant gas stream;

(2) work expanding the first cooled refrigerant gas stream to a first pressure to provided a cooled work-expanded refrigerant gas stream;

(3) further cooling and reducing the pressure of the second cooled refrigerant gas stream to a second pressure to provide a cooled reduced-pressure refrigerant gas stream, wherein reducing the pressure is effected by either work expansion or Joule-Thomson expansion across a throttling valve, and the second pressure is lower than the first pressure;

(4) warming the cooled reduced-pressure refrigerant gas stream in the second heat exchange zone to provide at least a portion of the cooling of the further-enriched hydrogen stream of (d), thereby providing a warmed reduced-pressure refrigerant gas stream;

(5) further warming the warmed reduced-pressure refrigerant gas stream in the first heat exchange zone to provide a portion of the cooling of the feed gas in (a), thereby providing a further-warmed reduced-pressure refrigerant gas;

(6) warming the cooled work-expanded refrigerant gas stream of (2) in the first heat exchange zone to provide at least a portion of the cooling of the feed gas in (a), thereby providing a warmed work-expanded refrigerant gas; and (7) compressing the further-warmed reduced-pressure refrigerant gas of (5) and the warmed work-expanded refrigerant gas of (6) to provide the compressed refrigerant gas in (1).

The refrigerant gas may be selected from the group consisting of nitrogen, methane, a mixture of nitrogen and methane, and air.

In another embodiment, the cooling in (a) and (c) may be effected in a first heat exchange zone, the first liquid stream of (b) may be introduced into a stripping column, and a liquid stream enriched in hydrocarbons containing two or more carbon atoms and a residual vapor stream enriched in methane may be withdrawn from the column. In addition, the further-enriched hydrogen stream of (d) may be cooled and partially condensed in a second heat exchange zone to provide a two-phase stream, and the two-phase stream may be separated to yield a hydrogen vapor product stream and an additional hydrocarbon-enriched liquid stream.

The method may further comprise reducing the pressure of the additional hydrocarbon-enriched liquid stream to yield a reduced-pressure hydrocarbon-enriched liquid stream, warming the reduced-pressure hydrocarbon-enriched liquid stream in the second heat exchange zone to provide an additional two-phase stream, separating the additional two-phase stream to provide a vapor stream containing hydrocarbons and residual hydrogen and a liquid stream further enriched in hydrocarbons, and introducing the liquid stream further enriched in hydrocarbons into the top of the stripping column. The vapor stream containing hydrocarbons and residual hydrogen may be warmed in the first heat exchange zone to provide a portion of the cooling of the feed gas in (a).

The method may further comprise warming the hydrogen vapor product stream in the second heat exchange zone to provide by indirect heat exchange a portion of the cooling of the further-enriched hydrogen stream and further warming the hydrogen product stream in the first heat exchange zone to provide by indirect heat exchange a portion of the cooling of the feed gas in (a). The residual vapor stream may be warmed in the first heat exchange zone to provide by indirect heat exchange a portion of the cooling of the feed gas in (a). A portion of the feed gas stream may be cooled by indirect heat exchange with one or more hydrocarbon-rich liquid streams withdrawn from a lower part of the stripping column to provide a cooled feed stream and one or more vaporized hydrocarbon-rich streams, the one or more vaporized hydrocarbon-rich streams may be returned to the stripping column to provide boil-up therein, and the cooled feed stream may be combined with the partially condensed feed of (a).

The cold gas refrigerant generated in the closed-loop gas expander refrigeration cycle may provide cooling in the first and second heat exchange zones by the steps of (1) providing a compressed refrigerant gas, dividing the compressed refrigerant gas into a first compressed refrigerant gas stream and a second compressed refrigerant gas stream, and work expanding the first compressed refrigerant gas stream to a first pressure to provided a first cooled work-expanded refrigerant gas stream;

(2) cooling the second compressed refrigerant gas stream in the first heat exchange zone to provide a cooled second compressed refrigerant gas stream;

(3) dividing the cooled second compressed refrigerant gas stream into a first portion and a second portion, work expanding the first portion to the first pressure to provide a second cooled work-expanded refrigerant gas stream, and further cooling the second portion in the first heat exchange zone to provide an intermediate cooled compressed refrigerant gas stream;

(4) warming the second cooled work-expanded refrigerant gas stream in the first heat exchange zone to provide a partially-warmed second work-expanded refrigerant gas stream and provide by indirect heat exchange a portion of the cooling of the feed stream in (a), and combining the partially-warmed second work-expanded refrigerant gas stream with the first cooled work-expanded refrigerant gas stream of (1) to provide a combined cooled work-expanded refrigerant gas stream;

(5) warming the combined cooled work-expanded refrigerant gas stream in the first heat exchange zone to provide by indirect heat exchange a portion of the cooling of the feed gas in (a), thereby providing a first warmed refrigerant gas stream;

(6) further cooling the intermediate cooled compressed refrigerant gas stream of (3) to provide a cold compressed refrigerant gas stream, reducing the pressure of the cold compressed refrigerant gas stream to a second pressure by either work expansion or Joule-Thomson expansion across a throttling valve, wherein the second pressure is lower than the first pressure, to provide a cold reduced-pressure refrigerant gas stream;

(7) warming the cold reduced-pressure refrigerant gas stream to provide by indirect heat exchange a portion of the cooling of the further-enriched hydrogen stream of (d) in the second heat exchange zone and a portion of the cooling of the feed gas of (a) in the first heat exchange zone, thereby providing a second warmed refrigerant gas stream; and (8) compressing the first and second warmed refrigerant gas streams to provide the compressed refrigerant gas in (1).

The refrigerant gas may be selected from the group consisting of nitrogen, methane, a mixture of nitrogen and methane, and air.

DETAILED DESCRIPTION OF THE INVENTION

The invention relates to processes for the recovery of hydrogen and one or more hydrocarbons having one or more carbon atoms from a feed gas containing hydrogen and the one or more hydrocarbons. The process utilizes a cryogenic separation method which includes cooling and partially condensing the feed gas to provide a partially condensed feed, separating the partially condensed feed to provide a first liquid stream enriched in the one or more hydrocarbons and a first vapor stream enriched in hydrogen, further cooling and partially condensing the first vapor stream to provide an intermediate two-phase stream, and separating the intermediate two-phase stream to yield a further-enriched hydrogen stream and a hydrogen-depleted residual hydrocarbon stream. Refrigeration to provide some or all of the cooling is obtained by indirect heat exchange with cold refrigerant gas streams generated in any of several closed-loop gas expander refrigeration cycles.

Three embodiments of the invention are described below with reference to the schematic flowsheets of FIGS. 1, 2, and 3. These flowsheets and the following descriptions are exemplary and do not necessarily limit the invention to any of the specific details shown in the flowsheets and described below.

Figure 1:
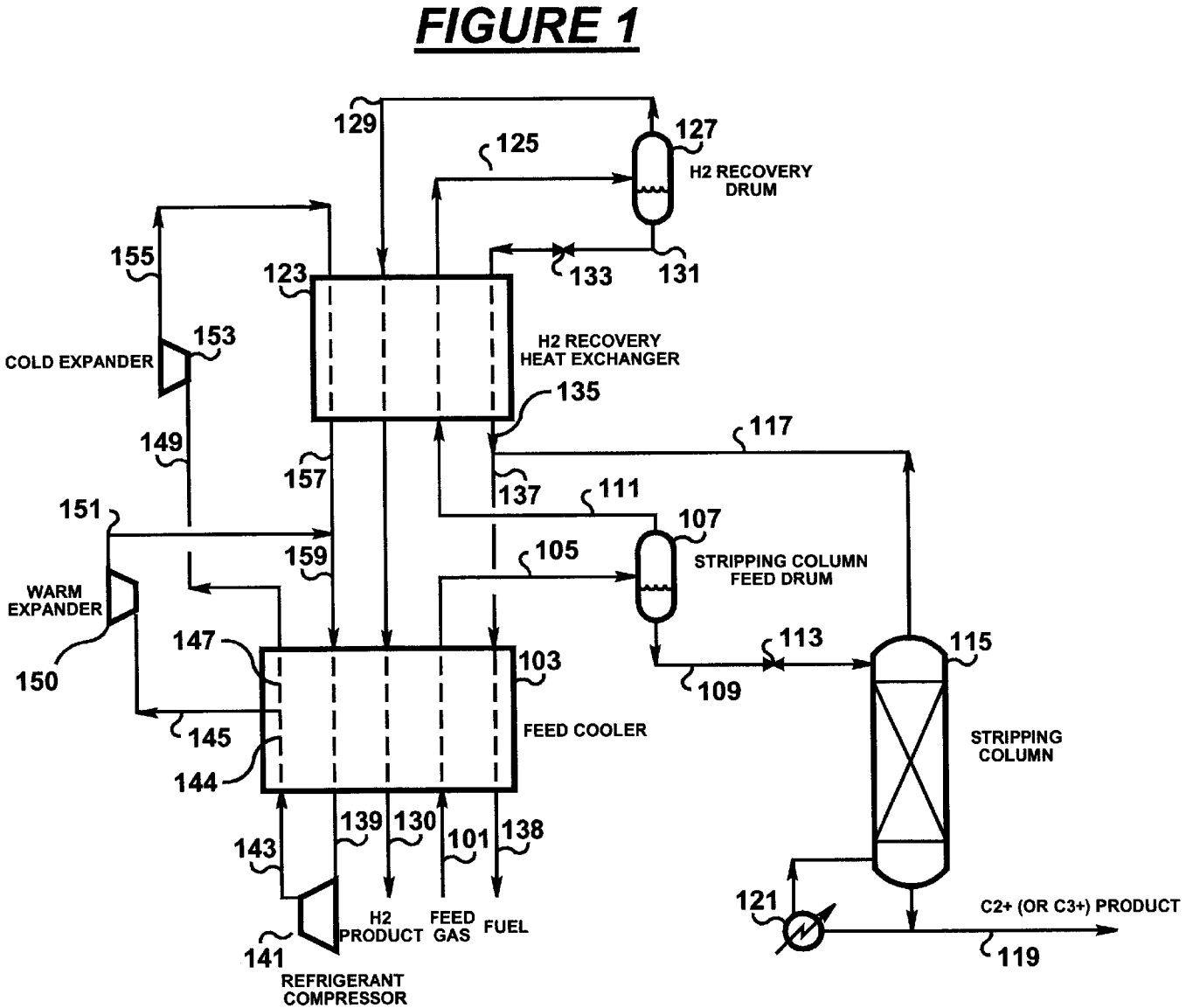
FIG. 1 is a schematic flow diagram of a first exemplary embodiment of the present invention.

A first embodiment of the invention is illustrated in the schematic flowsheet of FIG. 1. Pretreated feed gas is provided in line 101, typically at a pressure of 100 to 1000 psia and at ambient temperature, and contains hydrogen, one or more light hydrocarbons selected from methane, ethane, ethylene, propane, propylene, and optionally carbon monoxide, nitrogen, and/or $C_4^+$ hydrocarbons. The feed gas is pretreated in an upstream pretreatment step (not shown) to remove water and other components which can freeze out in the downstream processing. The feed gas is cooled and partially condensed in feed cooler or first heat exchange zone 103 by indirect heat exchange with several cold process streams (described later) to yield partially condensed feed in line 105. The partially condensed feed is separated in stripping column feed drum 107 to provide a first liquid stream enriched in hydrocarbons in line 109 and a first vapor stream enriched in hydrogen in line 111.

The first liquid stream may be reduced in pressure across valve 113 and introduced into optional stripping column 115, in which lighter hydrocarbons, residual hydrogen, and other light gases are stripped and withdrawn in overhead line 117. The heavier hydrocarbon fraction is withdrawn as liquid from the bottom of the stripping column via line 119 and contains $C_2^+$ product components such as ethylene and/or propylene. A portion of the stripping column bottoms stream is vaporized in heat exchanger 121 and returned to the column as boilup or stripping vapor. The stripping column typically operates at 50 to 400 psia in the temperature range of −200° F. to +50° F.

The first vapor stream enriched in hydrogen in line 111 is cooled and partially condensed in hydrogen recovery heat exchanger or second heat exchange zone 123 by indirect heat exchange with cold process streams (defined later) to yield a partially condensed stream typically at −200° F. to −300° F. in line 125. The partially condensed stream is separated in hydrogen recovery drum 127 to yield a hydrogen product stream in line 129 and a hydrogen-depleted residual hydrocarbon stream in line 131. The hydrogen product stream in line 129 is warmed in second heat exchange zone 123 by indirect heat exchange to provide a portion of the cooling for the stream entering in line 111, and then is further warmed in first heat exchange zone 103 by indirect heat exchange to provide a portion of the cooling for the feed gas entering in line 101. The final hydrogen product in line 130 is typically at ambient temperature and 15 to 30 psi below the feed gas pressure in line 101. This hydrogen product stream, which typically contains 80 to 97 mole % hydrogen, may be further purified by a pressure swing adsorption or membrane process if desired.

The hydrogen-depleted residual hydrocarbon stream in line 131 may be reduced in pressure across valve 133 and is warmed in second heat exchange zone 123 by indirect heat exchange to provide an additional portion of the cooling for the stream entering in line 111. The warmed stream in line 135 may be combined with the stripped gas stream in line 117, in which case the combined stream in line 137 is further warmed in first heat exchange zone 103 by indirect heat exchange to provide a portion of the cooling for the feed gas entering in line 101. The warmed residual hydrogen-hydrocarbon stream is withdrawn via line 138 and can be used as fuel.

A major portion of the refrigeration for this embodiment is provided by a closed-loop gas expander refrigeration system. A refrigerant gas, for example nitrogen, is withdrawn in line 139 from first heat exchange zone 103 and compressed to 600 to 1500 psia in refrigerant compressor 141. Other refrigerants may be used such as, for example, methane, a mixture of nitrogen and methane, or air. The compressed refrigerant gas is cooled in passage 144 of first heat exchange zone 103 to provide a cooled compressed refrigerant gas, which is divided into a first refrigerant gas stream withdrawn in line 145 and a second refrigerant gas stream in heat exchanger passage 147. The second refrigerant gas stream is further cooled in heat exchanger passage 147 to provide cooled refrigerant gas in line 149.

The first refrigerant gas stream in line 145 is work expanded in warm expander 150 to provided a cooled work-expanded refrigerant gas stream in line 151. The further cooled refrigerant gas in line 149 is work expanded in cold expander 153 to provide a cooled reduced-pressure refrigerant gas stream in line 155. Alternatively, instead of work expansion, the gas in line 149 can be reduced in pressure and cooled by Joule-Thomson expansion across a throttling valve (not shown). The cooled reduced-pressure refrigerant gas stream in line 155 is warmed in second heat exchange zone 123 to provide at least a portion of the cooling of the stream entering in line 111, thereby providing a warmed reduced-pressure refrigerant gas stream in line 157. The warmed reduced-pressure refrigerant gas stream in line 157 and the warmed work-expanded refrigerant gas stream in line 151 may be combined, in which case the combined stream in line 159 is warmed in first heat exchange zone 103 by indirect heat exchange to provide a portion of the cooling for the feed gas entering via line 101 and for the refrigerant flowing through passages 144 and 147. This provides a warmed reduced-pressure refrigerant gas stream in line 139 which is the refrigerant gas described above.

In stripping column 115, the first liquid stream in line 109 is separated to produce a light overhead gas stream in line 117 and a $C_2^+$- or $C_3^+$-enriched hydrocarbon product stream in line 119 that can be further separated and purified in additional columns if desired. The light overhead gas stream in line 117 from the stripping column can be recovered separately or combined with the hydrogen-depleted residual hydrocarbon stream in line 135 from the hydrogen recovery heat exchanger 123 and rewarmed in feed cooler 103 to be recovered as a fuel stream in line 138. Optionally, a refluxed de-methanizer or de-ethanizer column can be utilized in place of stripping column 115 to increase recovery of the desired hydrocarbon products. Alternatively, the first liquid feed stream in line 109 can be recovered directly from feed drum 107 without stripping or distillation, either as a liquid or vapor product that can be rewarmed in feed cooler 103 if desired to recover refrigeration.

Multiple partial condensation stages can be utilized to provide multiple feed streams to the column or to produce separate hydrocarbon products. For example, a $C_3$-rich hydrocarbon product could be produced from a warmer partial condensation stage and a $C_2$-rich hydrocarbon produced from a colder partial condensation stage. Stripping columns or refluxed distillation columns could be added to remove lighter impurities from one or both hydrocarbon products.

Alternatively, if the feed gas is lean in $C_2$ and heavier hydrocarbons, or if no $C_2^+$ hydrocarbon product is desired, only methane and upgraded methane-rich fuel gas would be recovered. Referring to FIG. 1, the upgraded methane-rich fuel gas product could be the hydrogen-depleted hydrocarbon stream in line 131, or the stripped gas stream in line 117 if stripping column 115 is utilized, or a combination of both, as in line 137. If the stripping column is utilized, the bottom liquid stream in line 119 could be vaporized in feed cooler 103 to provide refrigeration therein.

Figure 2:
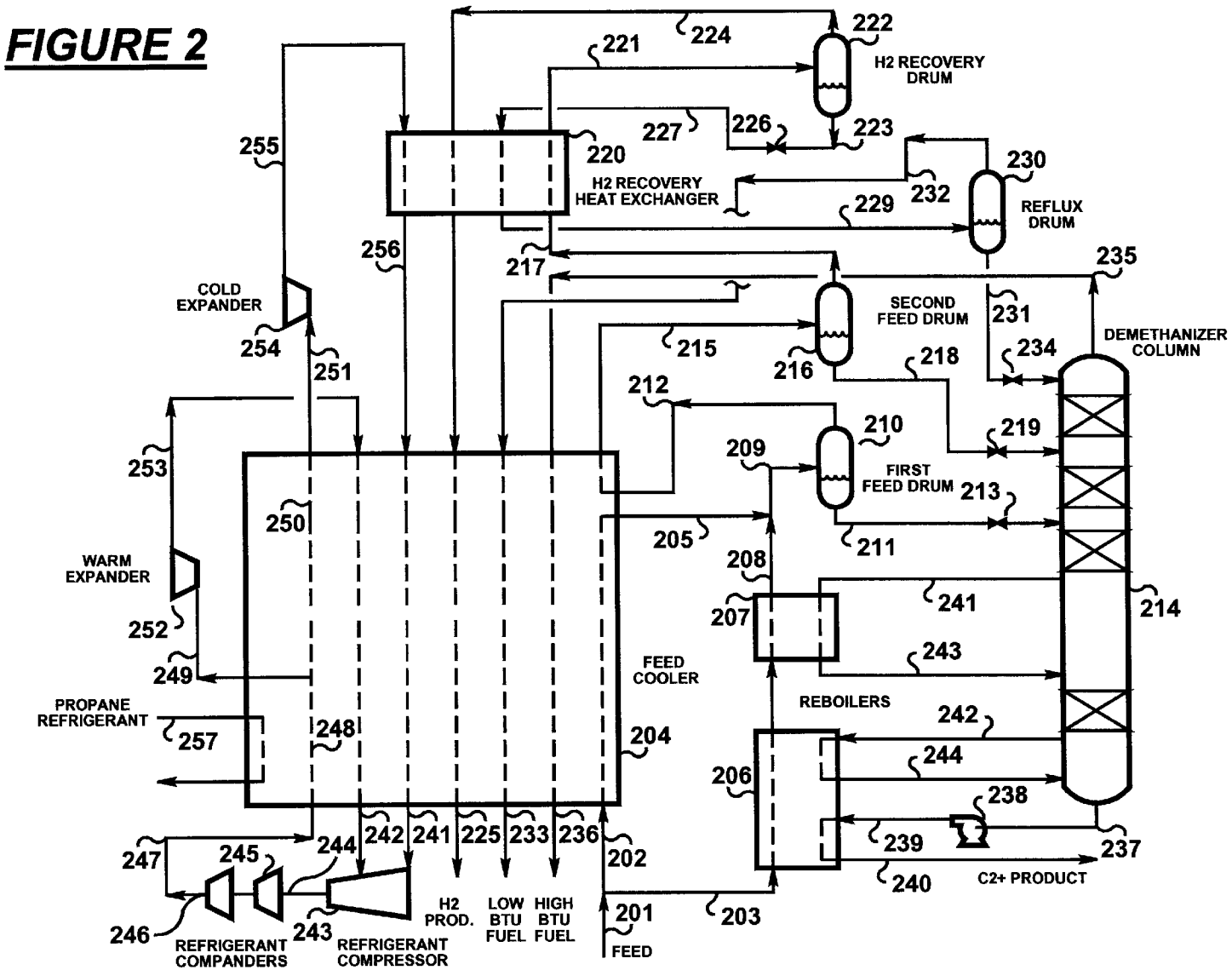
FIG. 2 is a schematic flow diagram of a second exemplary embodiment of the present invention.

A second embodiment of the invention is illustrated in the schematic flowsheet of FIG. 2. Pretreated feed gas is provided in line 201, typically at a pressure of 100 to 1000 psia and ambient temperature, and contains hydrogen, one or more light hydrocarbons selected from methane, ethylene, propane, propylene, and optionally carbon monoxide, nitrogen, and/or $C_4^+$ hydrocarbons. The feed gas is pretreated in an upstream pretreatment step (not shown) to remove water and other components which can freeze out in the downstream processing.

The feed gas may be divided into a first feed gas stream in line 202 and a second feed gas stream in line 203. The first feed gas stream in line 202 is cooled and partially condensed in feed cooler or first heat exchange zone 204 by indirect heat exchange with several cold process streams (described later) to yield partially condensed feed in line 205. The second feed gas stream in line 203 is cooled and partially condensed in reboiler heat exchangers 206 and 207 (described later) to yield partially a condensed feed stream in line 208. The two partially condensed feed streams are combined in line 209 and the combined stream is separated in first feed drum 210 to provide a first liquid stream enriched in hydrocarbons in line 211 and a first vapor stream enriched in hydrogen in line 212. The first liquid stream in line 211 may be reduced in pressure across valve 213 and is introduced into distillation column 214.

The first vapor stream in line 212 is further cooled and partially condensed in feed cooler or first heat exchange zone 204 to yield a partially condensed intermediate stream in line 215, which is separated in second feed drum 216 to yield a further-enriched hydrogen vapor stream in line 217 and a residual hydrocarbon liquid stream in line 218. The residual hydrocarbon stream in line 218 may be reduced in pressure across valve 219 and introduced into distillation column 214. The further-enriched hydrogen vapor stream in line 217 is further cooled and partially condensed in hydrogen recovery heat exchanger or second heat exchanger zone 220 to provide a partially condensed stream in line 221, which is separated in hydrogen recovery drum 222 to provide a hydrocarbon-enriched liquid stream in line 223 and a hydrogen vapor product stream in line 224.

The hydrogen vapor product stream in line 224 is warmed in second heat exchange zone 220 to provide by indirect heat transfer a portion of the cooling for the stream entering in line 217, and then is further warmed in first heat exchange zone 204 to provide by indirect heat transfer a portion of the cooling for the feed stream entering in line 202 and the stream entering in line 212. Final hydrogen product gas is withdrawn via line 225 and typically contains 80 to 97 mole % hydrogen.

The hydrocarbon-enriched liquid stream in line 223 may be reduced in pressure across valve 226 and the reduced-pressure stream in line 227 warmed in second heat exchange zone 220 to provide by indirect heat exchange a portion of the cooling for the stream entering in line 217. The warmed and partially vaporized stream in line 229 is separated in reflux drum 230 into a liquid hydrocarbon stream in line 231 and a waste hydrocarbon vapor in line 232. The waste hydrocarbon vapor in line 232, which comprises chiefly hydrogen, methane, and other light gases such as nitrogen and carbon monoxide, is warmed in first heat exchange zone 204 to provide by indirect heat transfer a portion of the cooling for the feed stream entering in line 202. The resulting warmed gas stream is withdrawn as a low BTU fuel gas in line 233.

The liquid hydrocarbon stream in line 231, which may contain chiefly methane with some ethane and ethylene, may be reduced in pressure across valve 234 and is introduced as reflux into the top of distillation column 214. A methane-rich overhead stream is withdrawn from the top of the column via line 235 and is warmed in first heat exchange zone 204 to provide by indirect heat transfer a portion of the cooling for the feed stream entering in line 202. The warmed stream is withdrawn as a high BTU fuel gas in line 236. Recovered $C_2^+$ hydrocarbon liquid product is withdrawn via line 237 and may be transferred via pump 238 and line 239 into reboiler heat exchanger 206, where it can be warmed to provide cooling for feed gas entering in line 203 as earlier described. Final $C_2^+$ hydrocarbon product then is withdrawn via line 240. One or more additional liquid sidestreams are withdrawn from distillation column 214 via lines 241 and 242, vaporized in reboilers 207 and 206 respectively, and returned via lines 243 and 244 to provide boilup vapor to the distillation column.

A major portion of the refrigeration for this embodiment is provided by a closed-loop gas expander refrigeration system. Refrigerant gas streams are withdrawn via lines 241 and 242 from feed cooler or first heat exchange zone 204. These streams, which may comprise nitrogen as the refrigerant, are typically at two different pressures as explained later. Other refrigerants may be used such as, for example, methane, a mixture of nitrogen and methane, or air. The two refrigerant streams in lines 241 and 242 enter refrigerant compressor 243 at the suction inlets of the appropriate compressor stages. The refrigerant gas is compressed to provide compressed refrigerant in line 244, and optionally may be further compressed in compressors or companders 245 and 246 which are driven by refrigerant work expansion as described later.

Compressed refrigerant gas, typically at to 600 to 1500 psia, flows via line 247 into first heat exchange zone 204 and is cooled in passage 248 therein. The cooled gas is divided into a first refrigerant stream which is withdrawn via line 249 and a second refrigerant stream which is further cooled in passage 250. A further cooled refrigerant stream is withdrawn via line 251. The first refrigerant stream in line 249 is work expanded to a first pressure in warm expander 252 to provide a cooled, work-expanded stream in line 253, and this stream is warmed in first heat exchange zone 204 to provide by indirect heat exchange a portion of the cooling for the feed gas entering in line 202 and for cooling the refrigerant flowing through passages 248 and 250. The warmed refrigerant is withdrawn via line 242 as earlier described.

The further cooled refrigerant stream in line 251 is work expanded in cold expander 254 to a second pressure, which is typically lower than the first pressure, to provide a cooled, work-expanded stream in line 255. This stream is warmed in second heat exchange zone 220 to provide by indirect heat exchange a portion of the cooling for the stream entering in line 217. The warmed refrigerant in line 256 is further warmed in first heat exchange zone 204 to provide by indirect heat exchange a portion of the cooling for the feed gas entering in line 202 and for cooling the refrigerant flowing through passages 248 and 250. The warmed refrigerant is withdrawn via line 241 as earlier described.

Figure 3:
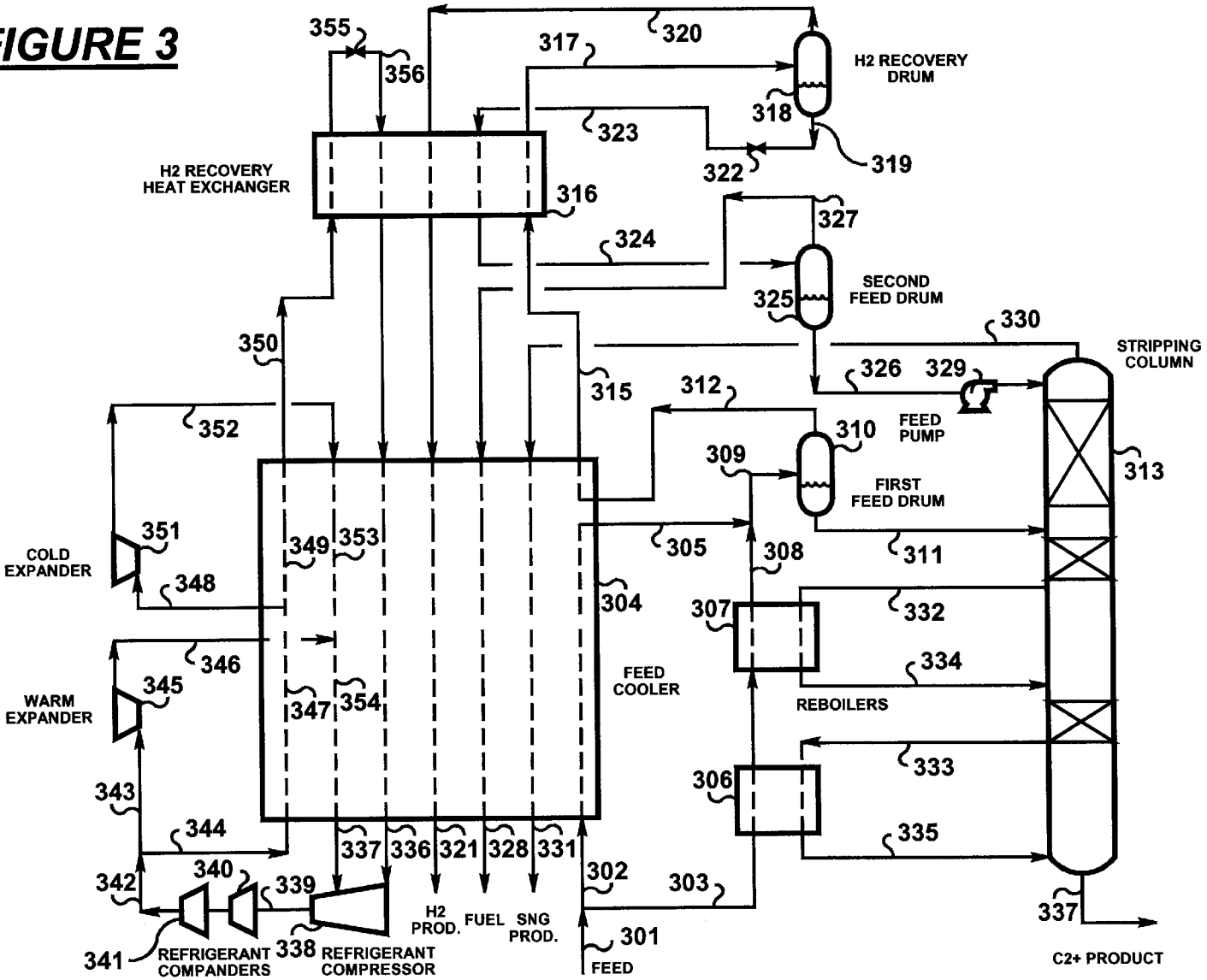
FIG. 3 is a schematic flow diagram of a third exemplary embodiment of the present invention.

A third embodiment of the invention is illustrated in the schematic flowsheet of FIG. 3. Pretreated feed gas is provided in line 301, typically at a pressure of 100 to 1000 psia and ambient temperature, and contains hydrogen, one or more light hydrocarbons selected from methane, ethylene, propane, propylene, and optionally carbon monoxide, nitrogen, and/or $C_4^+$ hydrocarbons. The feed gas is pretreated in an upstream pretreatment step (not shown) to remove water and other components which may freeze out in the downstream processing.

The feed gas may be divided into a first feed gas stream in line 302 and a second feed gas stream in line 303. The first feed gas stream in line 302 is cooled and partially condensed in feed cooler or first heat exchange zone 304 by indirect heat exchange with several cold process streams (described later) to yield partially condensed feed in line 305. The second feed gas stream in line 303 is cooled and partially condensed in reboiler heat exchangers 306 and 307 (described later) to yield partially a condensed feed stream in line 308. The two partially-condensed feed streams are combined in line 309 and the combined stream is separated in first feed drum 310 to provide a first liquid stream enriched in hydrocarbons in line 311 and a first vapor stream enriched in hydrogen in line 312. The first liquid stream in line 311 is introduced into stripping column 313.

The first vapor stream in line 312 is cooled and partially condensed in feed cooler or first heat exchange zone 304 to yield a partially condensed intermediate stream in line 315, which is further cooled in hydrogen recovery heat exchanger or second heat exchanger zone 316 to provide a partially condensed stream in line 317, which is separated in hydrogen recovery drum 318 to provide a hydrocarbon-enriched liquid stream in line 319 and a hydrogen vapor product stream in line 320.

The hydrogen vapor product stream in line 320 is warmed in second heat exchange zone 316 to provide by indirect heat transfer a portion of the cooling for the stream entering in line 315, and then is further warmed in first heat exchange zone 304 to provide by indirect heat transfer a portion of the cooling for the stream entering in line 312 and for the feed stream entering in line 302. Final hydrogen product gas is withdrawn via line 321 and typically contains 80 to 97 mole % hydrogen. The hydrocarbon-enriched liquid stream in line 319 may be reduced in pressure across valve 322 and the resulting stream in line 323 is warmed in second heat exchange zone 316 to provide by indirect heat exchange a portion of the cooling for the stream entering in line 315. The warmed and partially vaporized stream in line 324 is separated in second feed drum 325 into a liquid hydrocarbon stream in line 326 and a waste hydrocarbon vapor in line 327. The waste hydrocarbon vapor in line 327, which comprises chiefly hydrogen, methane, and other light gases such as nitrogen and carbon monoxide, is warmed in first heat exchange zone 304 to provide by indirect heat transfer a portion of the cooling for the feed stream in line 302. The warmed stream is withdrawn as a low BTU fuel gas in line 328.

The liquid hydrocarbon stream in line 326, which may contain chiefly methane with some ethane and ethylene, is pumped by feed pump 329 if necessary and introduced as feed into the top of stripping column 313. A methane-rich overhead stream is withdrawn from the top of the stripping column via line 330 and is warmed in first heat exchange zone 304 to provide by indirect heat transfer a portion of the cooling for the feed stream entering in line 302. The warmed stream is withdrawn as a methane-rich synthetic natural gas product in line 331. Recovered $C_2^+$ hydrocarbon product is withdrawn from the bottom of stripping column 313 via line 337. One or more liquid sidestreams are withdrawn from stripping column 313 via lines 332 and 333, vaporized in reboilers 307 and 306 respectively, and returned via lines 334 and 335 to provide boilup vapor to stripping column 313.

A major portion of the refrigeration for this embodiment is provided by a closed-loop gas expander refrigeration system. Warmed refrigerant gas streams are withdrawn via lines 336 and 337 from feed cooler or first heat exchange zone 304. These streams, which may comprise nitrogen as the refrigerant, are typically at two different pressures as explained later. Other refrigerants may be used such as, for example, methane, a mixture of nitrogen and methane, or air. These two streams in lines 336 and 337 enter refrigerant compressor 338 at the suction inlets of the appropriate compressor stages. The refrigerant gas is compressed to provide compressed refrigerant in line 339, and optionally may be further compressed in compressors or companders 340 and 341 which are driven by refrigerant work expansion as described later.

Compressed refrigerant gas typically at 600 to 1500 psia in line 342 is divided into first and second compressed refrigerant gas streams in lines 343 and 344 respectively. The first compressed refrigerant stream in line 343 is work expanded in warm expander 345 to provide a cooled work-expanded refrigerant stream in line 346. The second compressed refrigerant gas streams in line 344 is cooled in passage 347 of first heat exchange zone 304, a portion of the cooled refrigerant stream is withdrawn via line 348, and the remainder is further cooled in passage 349 to provide cold refrigerant in line 350.

The cooled refrigerant stream in line 348 is work expanded in cold expander 351 to provide cooled work-expanded refrigerant in line 352, which is warmed in passage 353 to provide by indirect heat exchange a portion of the cooling for feed gas entering in line 302, the stream entering in line 312, and refrigerant flowing in passage 349. The refrigerant in passage 353 is combined with the cooled work-expanded refrigerant stream in line 346 and the combined stream is further warmed in passage 354 to provide a portion of the cooling for feed gas entering in line 302 and refrigerant flowing in passage 347. The warmed refrigerant is withdrawn via line 337 as earlier described.

Cold refrigerant in line 350 is further cooled in second heat exchange zone 316 and is reduced in pressure by Joule-Thomson expansion across valve 355 to provide cold refrigerant in line 356. Alternatively, work expansion by a turboexpander (not shown) may be used to provide the cold refrigerant in line 356. The cold refrigerant in line 356 is warmed in second heat exchange zone 316 to provide a portion of the cooling for the stream entering in line 327, and then is further warmed in first heat exchange zone 304 to provide by indirect heat transfer a portion of the cooling for the feed gas entering in line 302 and refrigerant flowing in passages 347 and 349. The final warmed refrigerant gas is withdrawn via line 336 as earlier described.

The following Examples illustrate the present invention but do not limit the invention to any of the specific details described therein.

EXAMPLE 1

The embodiment of FIG. 2 is operated using a nitrogen refrigerated cryogenic separation process with two expanders for the recovery of an ethylene/propylene-rich liquid product, a hydrogen product, and a methane-rich high BTU fuel gas stream from the off-gas of a fluid catalytic cracking (FCC) unit. The dried feed gas in line 201 has a flow rate of 16,145 lb moles per hour with a composition of 13.3 mole % hydrogen, 6.8% nitrogen and carbon monoxide (CO), 35.4% methane, 11.3% ethylene, 15.8% ethane, 11.2% propylene and 6.2% propane and heavier hydrocarbons, at 96° F. and 455 psia. Most of the feed is cooled and partially condensed in feed cooler 204 and the remainder is cooled in reboilers 206 and 207 of demethanizer column 214.

Condensed liquid having a flow rate of 9563 lb moles per hour at −109° F. and containing 28.9 mole % methane and lighter components, 16.8% ethylene, 25.1 % ethane, 18.7% propylene and 10.5% propane and heavier hydrocarbons, is separated in first feed drum 210 and flows via line 211 into demethanizer column 214. The uncondensed vapor in line 212 is further cooled and partially condensed in feed cooler 204. The partially condensed stream in line 215 is separated in second feed drum 216 to provide a condensed liquid stream in line 218 with a flow rate of 1430 lb moles per hour at −175° F. containing 75.7 mole % methane and lighter components, 12.4% ethylene, 10.2% ethane, 1.4% propylene and 0.3% propane and heavier hydrocarbons. This stream also is introduced into demethanizer column 214.

Uncondensed vapor in line 217 is then further cooled and partially condensed in hydrogen recovery heat exchanger 220 and separated in hydrogen recovery drum 222. Condensed liquid is withdrawn from this drum in line 223 with a flow rate of 2975 lb moles per hour at −291° F. containing 2.9 mole % hydrogen, 23.7% nitrogen and CO, 72.0% methane and 1.4% ethylene and ethane. This condensed liquid is flashed across valve 226 to −290° F. and 145 psia and the flashed stream in line 227 is warmed to a temperature −203° F. and partially vaporized in hydrogen recovery heat exchanger 220. The two-phase stream in line 229 is separated in reflux drum 230 and unvaporized liquid is withdrawn therefrom via line 231 at 480 lb moles per hour containing 0.1 mole % hydrogen, 4.4% nitrogen and CO, 88.1% methane and 7.4% ethylene and ethane. This liquid is introduced as reflux into the top of demethanizer column 214.

The vapor stream in line 232 is withdrawn from reflux drum 230 at 2495 lb moles per hour and contains 3.4 mole % hydrogen, 27.4% nitrogen and CO, 68.9% methane and 0.3% ethylene and ethane. The stream is further warmed in feed cooler 204 and is recovered at 93° F. and 140 psia as a low BTU fuel stream in line 233. The hydrogen-enriched vapor product in line 224 from hydrogen recovery drum 222, at a flow rate of 2177 lb moles per hour containing 90.7 mole % hydrogen, 8.4% nitrogen and CO, and 0.9% methane, is warmed in hydrogen recovery heat exchanger 220 and feed cooler 204, and is recovered at 93° F. and 435 psia as a hydrogen product stream in line 225.

In demethanizer column 214, the liquid feed and reflux streams are separated to produce a light overhead gas stream in line 235 and an ethylene/propylene-enriched bottom liquid stream in line 237. The ethylene/propylene-rich liquid product, which is withdrawn at a flow rate of 7152 lb moles per hour and contains 24.9 mole % ethylene, 35.7% ethane, 25.3% propylene and 14.2% propane and heavier hydrocarbons, is recovered from the bottom of demethanizer column 214 via line 237 at −16° F. and 146 psia and is pumped to 550 psia and warmed to 93° F. in the demethanizer column reboiler 206. This ethylene/propylene-enriched liquid product stream is withdrawn in line 240 and can be further separated in additional distillation columns to produce, for example, purified ethylene and propylene products if desired. The light overhead vapor stream in line 235, having a flow rate of 4321 lb moles per hour at −190° F. and containing 1.9 mole % hydrogen, 5.3% nitrogen and CO, 92.0% methane and 0.8% ethylene and ethane, is warmed separately in feed cooler 204 and recovered at 93° F. and 135 psia as a high BTU fuel stream in line 236.

Most of the refrigeration required for this cryogenic separation process is supplied by a closed-loop nitrogen recycle refrigeration system. Two low pressure nitrogen streams, one in line 241 at 2200 lb moles per hour at 93° F. and 47 psia, and the other in line 242 at 22,091 lb moles per hour at 93° F. and 282 psia, are compressed to 1050 psia in refrigerant compressor 243 and in expander-driven compressors or companders 245 and 246. The compressed nitrogen in line 247 is cooled to 100° F. in an aftercooler (not shown) and then is further cooled in passage 248 of feed cooler 204. Most of the cooled nitrogen, 22,091 lb moles per hour at −21° F. is withdrawn at an intermediate point of the feed cooler via line 249, expanded to −150° F. and 289 psia in warm expander 252, and returned via line 253 to feed cooler 204 to provide low level refrigeration for the feed gas entering in line 202.

The remainder of the nitrogen, having a flow rate of 2200 lb moles per hour, is cooled in passage 250 to −145° F., expanded to −299° F. and 50 psia in cold expander 254, and sent to hydrogen recovery heat exchanger 220 to provide low temperature refrigeration for hydrogen recovery. This expanded nitrogen stream is warmed to −203° F. in the hydrogen recovery heat exchanger. Both expanded nitrogen streams in lines 253 and 256 are then warmed separately to 93° F. in the feed cooler to be recycled to the nitrogen compressor at two pressure levels via lines 241 and 242. A conventional vapor compression refrigeration system utilizing propylene, propane, or freon, for example, is utilized to provide the large amount of high level refrigeration at 43° F. via line 257, since this type of refrigeration system is generally more efficient than expander refrigeration at temperature levels above about −25° F.

This process recovers 98.0% of the ethylene, 99.85% of the ethane and essentially 100% of the propylene and heavier components from the feed gas in line 201 as a hydrocarbon liquid product in line 240 containing less than 0.0025 mole % methane and lighter impurities. The process also recovers 92.1% of the hydrogen in the feed gas at a purity of 90.7 mole % hydrogen in line 225. Separate low and high BTU fuel streams in lines 233 and 236 also are recovered with methane purities of 68.9 mole % and 92.0 mole % respectively.

For ethylene and ethane recovery described in this example, it may be desirable to utilize additional expanders to meet the refrigeration requirements of the separation process in a more energy-efficient manner, such as when the feed gas is at a lower pressure or when a higher purity hydrogen product is desired. The closed-loop refrigerant could be expanded to three or more temperature levels from one or more pressure levels and also could be returned to the refrigerant compressor at several pressure levels. If the hydrogen product is required at a significantly lower pressure than the feed, it is also possible to supplement the closed-loop recycle refrigeration by work expansion of the hydrogen. Alternately, if some or all of the hydrocarbon product is recovered as a vapor, a significant amount of refrigeration can be recovered from the vaporization of the recovered liquid and it may be possible to eliminate one or more of the expanders. A similar process can be used to recover propylene and/or propane and hydrogen without ethylene/ethane recovery.

EXAMPLE 2

The embodiment of FIG. 3 is operated using a nitrogen refrigerated cryogenic separation process with two expanders and a separate low temperature Joule-Thomson expansion refrigeration loop for the recovery of ethylene and heavier hydrocarbons in combination with a hydrogen product stream and a methane-rich gas (synthetic natural gas or SNG) product stream from a mixture of off-gases from various petrochemical units.

Pretreated, dried feed gas in line 301 is provided at a flow rate of 7407 lb moles per hour with a composition of 21.9 mole % hydrogen, 4.3% nitrogen, oxygen ($O_2$) and carbon monoxide (CO), 43.6% methane, 5.8% ethylene, 16.2% ethane, 1.7% propylene and 6.5% propane and heavier hydrocarbons, at 99° F. and 335 psia. A major portion of the feed via line 302 is cooled and partially condensed in feed cooler 304 and a small portion of the feed via line 303 is cooled in stripping column reboilers 306 and 307. Partially condensed feed in line 309 is separated in first feed drum 310 to provide condensed liquid in line 311 at 3835 lb moles per hour and −160° F. containing 43.1 mole % methane and lighter components, 10.6% ethylene, 30.6% ethane, 3.2% propylene and 12.5% propane and heavier hydrocarbons. This liquid is introduced into stripping column 313.

The uncondensed vapor in line 312 is further cooled and partially condensed in feed cooler 304 and in hydrogen recovery heat exchanger 316. The partially-condensed stream in line 317 is separated in hydrogen recovery drum 318 and a condensed liquid is withdrawn via line 319 at 1742 lb moles per hour and −258° F. containing 96.8 mole % methane and lighter components, 1.5% ethylene, and 1.7% ethane and heavier hydrocarbons. This liquid is flashed across valve 322 to −259° F. and 70 psia, and then is warmed to −234° F. and partially vaporized in hydrogen recovery heat exchanger 316 to reduce the amount of nitrogen and other light components in the unvaporized liquid. The two-phase stream in line 324 is separated in second feed drum 325, and a liquid is withdrawn therefrom via line 326 at 1505 lb moles per hour containing 0.1 mole % hydrogen, 3.9% nitrogen, $O_2$ and CO, 92.4% methane, and 3.6% ethylene and ethane. This liquid optionally may be pumped via pump 329 before introduction into stripping column 313.

The vapor stream from second feed drum 325 is withdrawn via line 327 at 237 lb moles per hour and contains 13.7 mole % hydrogen, 56.9% methane, and 29.4% nitrogen, $O_2$ and CO. This vapor stream is further warmed in feed cooler 304 and recovered at 97° F. and 65 psia as a low BTU fuel stream in line 328. The hydrogen-enriched vapor is withdrawn from hydrogen recovery drum 318 via line 320 at 1830 lb moles per hour and contains 85.6 mole % hydrogen, 5.9% methane, and 8.5% nitrogen, $O_2$ and CO. This stream is warmed in hydrogen recovery heat exchanger 316 and feed cooler 304, and is recovered at 97° F. and 320 psia as a hydrogen product stream in line 321. The hydrogen product stream can be further purified in a pressure swing adsorption or membrane system to provide a higher purity hydrogen product if desired.

In stripping column 313, the liquid feed streams are separated to produce a light overhead gas stream in line 330 and an ethane/propane-enriched bottom liquid stream in line 337. The ethane/propane-rich liquid product in line 337, which is withdrawn at a flow rate of 2140 lb moles per hour and contains 0.5 mole % methane, 17.9% ethylene, 53.5% ethane, 5.7% propylene, and 22.4% propane and heavier hydrocarbons, is recovered at −5° F. and 183 psia. This ethane/propane-enriched liquid stream can be further separated in additional distillation columns to produce, for example, separate ethane/ethylene and propane/propylene products if desired. A light overhead vapor stream is withdrawn from the stripping column via line 330 at a flow rate of 3201 lb moles per hour and −150° F. and contains 0.7 mole % hydrogen, 92.9% methane, 3.4% ethylene and ethane, and 3.0% nitrogen, $O_2$ and CO. This vapor stream is warmed in feed cooler 304 and recovered at 97° F. and 176 psia as a high BTU, low nitrogen synthetic natural gas stream via line 331.

Most of the refrigeration required for this cryogenic separation process is supplied by a closed-loop nitrogen recycle refrigeration system. Two low pressure nitrogen streams, one in line 336 at 255 lb moles per hour, 97° F., and 58 psia and the other in line 337 at 17,057 lb moles per hour, 97° F., and 204 psia, are compressed to 1000 psia in refrigerant compressor 338 and expander-driven compressors or companders 340 and 341. These are driven by the expanders described below. The compressed nitrogen in line 342 is cooled to 100° F. in an aftercooler (not shown), and a first portion of the nitrogen in line 343 at 5199 lb moles per hour is work expanded to 86° F. and 209 psia in warm expander 345 and flows via line 346 to feed cooler 304 to provide high level refrigeration therein.

The second portion of the compressed nitrogen stream in line 344 is cooled in flow passage 347 of feed cooler 304 to −110° F. This cooled nitrogen stream is divided and a first portion is withdrawn from an intermediate point of feed cooler 304 via line 348 at a flow rate of 11,858 lb moles per hour, expanded to −233° F. and 209 psia in the cold expander 351, and returned via line 352 to feed cooler 304 to provide low level refrigeration in passageway 353 therein. The second portion of the cooled nitrogen at 255 lb moles per hour is further cooled in passage 349 to −258° F., withdrawn via line 350, further cooled in hydrogen recovery heat exchanger 316, and is reduced in pressure by Joule-Thomson expansion across valve 355 to −294° F. and 63 psia. The cooled, expanded nitrogen in line 356 is warmed in hydrogen recovery heat exchanger 316 to provide low temperature refrigeration therein, is further warmed to 97° F. in feed cooler 304 to provide refrigeration therein, and is withdrawn via line 336 and recycled to refrigerant compressor 338 as earlier described. The two work-expanded nitrogen streams in line 346 and passageway 353 are combined and warmed in passageway 354 of feed cooler 304 to provide refrigeration therein, and the warmed nitrogen is withdrawn at 97° F. via line 337 to nitrogen compressor 338 at an intermediate pressure level.

The process of this Example recovers 88.6% of the ethylene, 95.2% of the ethane, 99.5% of the propylene and propane, and essentially 100% of the $C_4$ and heavier components in the feed gas to yield the liquid hydrocarbon product in line 355 which contains 0.5 mole % methane impurity. The process also recovers 96.55% of the hydrogen in the feed gas at a purity of 85.6 mole % hydrogen in line 321. More than 92% of the methane in the feed gas is recovered as a synthetic natural gas product stream in line 331 containing 92.9 mole % methane with 0.7% hydrogen and 3.0% nitrogen and other light impurities.

A higher purity hydrogen product can be achieved by cooling the nitrogen Joule-Thomson expansion stream in line 356 to a colder temperature by expansion to a lower pressure and temperature. This would allow hydrogen recovery drum 318 to be operated at a lower temperature. For example, if the flow of the nitrogen stream in line 344 were to be increased by about 35% and the cooled nitrogen stream in line 350 and the vapor in line 324 from first feed drum 310 were to be cooled to −296° F. in hydrogen recovery heat exchanger 316 by expanding the nitrogen across valve 355 to −299° F. and 48 psia, a hydrogen purity of 95.5 mole % could be achieved in hydrogen recovery drum 318.

Many alternative flow schemes are possible for the closed-loop refrigeration system of the present invention. These alternatives may result in lower power requirements and/or lower capital cost, depending on the particular requirements for refrigeration at various temperature levels. These refrigeration requirements are determined primarily by the feed gas pressure and composition and the level of hydrocarbon product recovery and hydrogen product purity required. A portion of the closed-loop refrigerant can be expanded to a higher pressure level in one of the expanders and returned to the refrigerant compressor at an intermediate pressure level as in FIG. 2, or all of the expanders can operate at the same pressure levels, as in FIG. 3. Alternatively, a portion of the closed-loop refrigerant could be removed from the refrigerant compressor at an intermediate stage, cooled separately and expanded in one of the expanders to the lowest pressure level or to another intermediate pressure level. The separate Joule-Thomson expansion loop utilized to provide refrigeration for the hydrogen recovery section of the process in FIG. 3 would typically operate at the lowest pressure level but may be operated at any intermediate pressure level. The Joule-Thomson expansion could be replaced by work expansion if the amount of low temperature refrigeration required is large enough to justify the cost of an additional expander, as in FIG. 2.

In this invention, the closed-loop gas expander refrigeration system can supply refrigeration at any required temperature level, but operates most efficiently and economically in the range of about −50° F. to −300° F. At this low temperature level, very high $C_2$ or $C_3$ hydrocarbon and hydrogen recovery is possible even with relatively low pressure feed gases, and thus minimal feed compression would be required. The closed-loop recycle refrigerated process can achieve much higher recoveries than processes that utilize work expansion of feed gas or light residue gas, where recovery is limited by the refrigeration available between the feed gas inlet pressure and the residue gas delivery pressure.

In utilizing nitrogen as the refrigerant, this process will have a lower capital cost than similar processes that utilize conventional cascade refrigeration systems or mixed refrigerant refrigeration systems due to the relatively low cost and high efficiency of nitrogen compressors and expanders as compared to hydrocarbon compression equipment. No complex refrigerant make-up systems are required because nitrogen is normally available in most refinery and petrochemical facilities for use as inert gas or for purging of equipment. Alternatively, air, methane, or mixtures of nitrogen and methane could be utilized as the refrigerant gas if desired.

Since most of the closed-loop refrigerant typically is maintained above 100 psia and preferably above 200 psia throughout the process, pressure drop losses are small compared to hydrocarbon or freon refrigerants that are generally vaporized at much lower pressures for refrigeration. Typically the gaseous refrigerant of the present invention is compressed to at least 600 psia, and preferably at least 1000 psia, to provide the most energy-efficient process. Higher pressures are usually even more energy-efficient, but the power savings must be evaluated against the additional cost of higher-pressure equipment.

A plant using any of the processes described above also will have a lower capital cost than plants which utilize absorption for hydrocarbon and hydrogen recovery, since those processes require multiple distillation columns to absorb and strip the hydrocarbon product and light gases from the absorption solvents, in addition to any columns required to remove light or heavy impurities from the hydrocarbon product(s). Also, a significant amount of external refrigeration usually is required to refrigerate the solvents in order to achieve high $C_2$ and hydrogen recovery.

What is claimed is:

1. A method for the recovery of hydrogen and one or more hydrocarbons having one or more carbon atoms from a feed gas containing hydrogen and the one or more hydrocarbons, which process comprises:

(a) cooling and partially condensing the feed gas to provide a partially condensed feed;

(b) separating the partially condensed feed to provide a first liquid stream enriched in the one or more hydrocarbons and a first vapor stream enriched in hydrogen;

(c) further cooling and partially condensing the first vapor stream to provide an intermediate two-phase stream; and (d) separating the intermediate two-phase stream to yield a further-enriched hydrogen stream and a hydrogen-depleted residual hydrocarbon stream;

wherein some or all of the cooling in (a), or in (c), or in (a) and (c) is provided by indirect heat exchange with cold gas refrigerant generated in a closed-loop gas expander refrigeration cycle.

2. The method of claim 1 wherein the cooling in (a) is effected in a first heat exchange zone and the further cooling in (c) is effected in a second heat exchange zone.

3. The method of claim 2 which further comprises introducing the first liquid stream into a stripping column, and withdrawing therefrom a liquid stream further enriched in the one or more hydrocarbons and a residual vapor stream comprising hydrogen and portions of the one or more hydrocarbons.

4. The method of claim 3 which further comprises reducing the pressure of the hydrogen-depleted residual hydrocarbon stream of (d) to yield a reduced-pressure residual hydrocarbon stream and warming the reduced-pressure residual hydrocarbon stream in the second heat exchange zone by indirect heat exchange with the first vapor stream enriched in hydrogen to provide a portion of the cooling in (c), thereby providing a warmed residual hydrocarbon stream.

5. The method of claim 4 which further comprises combining the residual vapor stream from the stripping column and the warmed residual hydrocarbon stream from the second heat exchange zone to provide a combined residual stream, and warming the combined residual stream by indirect heat exchange with the feed gas in the first heat exchange zone, thereby providing a portion of the cooling of the feed gas in (a).

6. The method of claim 2 wherein the cold gas refrigerant generated in the closed-loop gas expander refrigeration cycle provides cooling in the first and second heat exchange zones by the steps of (1) compressing and cooling a refrigerant gas to provide a cooled compressed refrigerant gas and dividing the cooled compressed refrigerant gas into a first and a second cooled refrigerant gas stream;

(2) work expanding the first cooled refrigerant gas stream to provided a cooled work-expanded refrigerant gas stream;

(3) further cooling and reducing the pressure of the second cooled refrigerant gas stream to provide a cooled reduced-pressure refrigerant gas stream, wherein reducing the pressure is effected by either work expansion or Joule-Thomson expansion across a throttling valve;

(4) warming the cooled reduced-pressure refrigerant gas stream in the second heat exchange zone to provide at least a portion of the cooling of the first vapor stream in (c), thereby providing a warmed reduced-pressure refrigerant gas stream; and (5) combining the cooled work-expanded refrigerant gas stream of (2) and the warmed reduced-pressure refrigerant gas stream of (4) to provide a combined reduced-pressure refrigerant gas stream and warming the combined reduced-pressure refrigerant gas stream in the first heat exchange zone to provide at least a portion of the cooling of the feed gas in (a), thereby warming the combined reduced-pressure refrigerant gas stream to provide the refrigerant gas of (1).

7. The method of claim 6 wherein the refrigerant gas is selected from the group consisting of nitrogen, methane, a mixture of nitrogen and methane, and air.

8. The method of claim 2 which further comprises warming the further-enriched hydrogen stream of (d) in the first and second heat exchange zones to provide by indirect heat exchange a portion of the cooling of the feed gas in (a) and a portion of the cooling of the first vapor stream in (c).

9. The method of claim 1 wherein the cooling in (a) and (c) is effected in a first heat exchange zone and wherein the method further comprises introducing the first liquid stream of (b) into a distillation column, and withdrawing therefrom a liquid stream enriched in hydrocarbons containing two or more carbon atoms and a residual vapor stream enriched in methane.

10. The method of claim 9 which further comprises introducing the intermediate two-phase stream of (c) into the distillation column.

11. The method of claim 9 which further comprises warming the residual vapor stream in the first heat exchange zone to provide by indirect heat exchange at least a portion of the cooling of the feed gas in (a).

12. The method of claim 9 which further comprises cooling and partially condensing the further-enriched hydrogen stream of (d) in a second heat exchange zone to provide an additional intermediate two-phase stream, and separating the additional intermediate two-phase stream to yield a hydrogen product stream and an additional hydrogen-depleted residual hydrocarbon stream.

13. The method of claim 12 which further comprises warming the hydrogen product stream in the first and second heat exchange zones to provide by indirect heat exchange a portion of the cooling of the feed gas in (a) and a portion of the cooling of the further-enriched hydrogen stream.

14. The method of claim 12 which further comprises reducing the pressure of the additional hydrogen-depleted residual hydrocarbon liquid stream to yield a reduced-pressure residual hydrocarbon liquid stream, warming the reduced-pressure residual hydrocarbon liquid stream in the second heat exchange zone to yield a two-phase residual hydrocarbon liquid stream, separating the two-phase residual hydrocarbon stream to yield a residual hydrocarbon vapor stream and an enriched hydrocarbon liquid stream, and introducing the enriched hydrocarbon liquid stream into the distillation column as reflux.

15. The method of claim 14 which further comprises warming the residual hydrocarbon vapor stream in the first heat exchange zone to provide a portion of the cooling of the feed gas in (a).

16. The method of claim 9 wherein a portion of the feed gas stream is cooled by indirect heat exchange with one or more hydrocarbon-rich liquid streams withdrawn from a lower part of the distillation column to provide a cooled feed stream and one or more vaporized hydrocarbon-rich streams, the one or more vaporized hydrocarbon-rich streams are returned to the distillation column to provide boil-up therein, and the cooled feed stream is combined with the partially condensed feed of (a).

17. The method of claim 12 wherein the cold gas refrigerant generated in the closed-loop work expander refrigeration cycle provides cooling in the first and second heat exchange zones by the steps of (1) providing a compressed refrigerant gas, cooling the compressed refrigerant gas to provide a cooled compressed refrigerant gas, and dividing the cooled compressed refrigerant gas into a first and a second cooled refrigerant gas stream;

(2) work expanding the first cooled refrigerant gas stream to a first pressure to provided a cooled work-expanded refrigerant gas stream;

(3) further cooling and reducing the pressure of the second cooled refrigerant gas stream to a second pressure to provide a cooled reduced-pressure refrigerant gas stream, wherein reducing the pressure is effected by either work expansion or Joule-Thomson expansion across a throttling valve, and the second pressure is lower than the first pressure;

(4) warming the cooled reduced-pressure refrigerant gas stream in the second heat exchange zone to provide at least a portion of the cooling of the further-enriched hydrogen stream of (d), thereby providing a warmed reduced-pressure refrigerant gas stream;

(5) further warming the warmed reduced-pressure refrigerant gas stream in the first heat exchange zone to provide a portion of the cooling of the feed gas in (a), thereby providing a further-warmed reduced-pressure refrigerant gas;

(6) warming the cooled work-expanded refrigerant gas stream of (2) in the first heat exchange zone to provide at least a portion of the cooling of the feed gas in (a), thereby providing a warmed work-expanded refrigerant gas; and (7) compressing the further-warmed reduced-pressure refrigerant gas of (5) and the warmed work-expanded refrigerant gas of (6) to provide the compressed refrigerant gas in (1).

18. The method of claim 17 wherein the refrigerant gas is selected from the group consisting of nitrogen, methane, a mixture of nitrogen and methane, and air.

19. The method of claim 1 wherein the cooling in (a) and (c) is effected in a first heat exchange zone and wherein the method further comprises introducing the first liquid stream of (b) into a stripping column and withdrawing therefrom a liquid stream enriched in hydrocarbons containing two or more carbon atoms and a residual vapor stream enriched in methane.

20. The method of claim 19 which further comprises cooling and partially condensing the further-enriched hydrogen stream of (d) in a second heat exchange zone to provide a two-phase stream and separating the two-phase stream to yield a hydrogen vapor product stream and an additional hydrocarbon-enriched liquid stream.

21. The method of claim 20 which further comprises reducing the pressure of the additional hydrocarbon-enriched liquid stream to yield a reduced-pressure hydrocarbon-enriched liquid stream, warming the reduced-pressure hydrocarbon-enriched liquid stream in the second heat exchange zone to provide an additional two-phase stream, separating the additional two-phase stream to provide a vapor stream containing hydrocarbons and residual hydrogen and a liquid stream further enriched in hydrocarbons, and introducing the liquid stream further enriched in hydrocarbons into the top of the stripping column.

22. The method of claim 21 which further comprises warming the vapor stream containing hydrocarbons and residual hydrogen in the first heat exchange zone to provide a portion of the cooling of the feed gas in (a).

23. The method of claim 20 which further comprises warming the hydrogen vapor product stream in the second heat exchange zone to provide by indirect heat exchange a portion of the cooling of the further-enriched hydrogen stream and further warming the hydrogen product stream in the first heat exchange zone to provide by indirect heat exchange a portion of the cooling of the feed gas in (a).

24. The method of claim 20 which further comprises warming the residual vapor stream in the first heat exchange zone to provide by indirect heat exchange a portion of the cooling of the feed gas in (a).

25. The method of claim 20 wherein a portion of the feed gas stream is cooled by indirect heat exchange with one or more hydrocarbon-rich liquid streams withdrawn from a lower part of the stripping column to provide a cooled feed stream and one or more vaporized hydrocarbon-rich streams, the one or more vaporized hydrocarbon-rich streams are returned to the stripping column to provide boil-up therein, and the cooled feed stream is combined with the partially condensed feed of (a).

26. The method of claim 20 wherein the cold gas refrigerant generated in the closed-loop gas expander refrigeration cycle provides cooling in the first and second heat exchange zones by the steps of (1) providing a compressed refrigerant gas, dividing the compressed refrigerant gas into a first compressed refrigerant gas stream and a second compressed refrigerant gas stream, and work expanding the first compressed refrigerant gas stream to a first pressure to provided a first cooled work-expanded refrigerant gas stream;

(2) cooling the second compressed refrigerant gas stream in the first heat exchange zone to provide a cooled second compressed refrigerant gas stream;

(3) dividing the cooled second compressed refrigerant gas stream into a first portion and a second portion, work expanding the first portion to the first pressure to provide a second cooled work-expanded refrigerant gas stream, and further cooling the second portion in the first heat exchange zone to provide an intermediate cooled compressed refrigerant gas stream;

(4) warming the second cooled work-expanded refrigerant gas stream in the first heat exchange zone to provide a partially-warmed second work-expanded refrigerant gas stream and provide by indirect heat exchange a portion of the cooling of the feed stream in (a), and combining the partially-warmed second work-expanded refrigerant gas stream with the first cooled work-expanded refrigerant gas stream of (1) to provide a combined cooled work-expanded refrigerant gas stream;

(5) warming the combined cooled work-expanded refrigerant gas stream in the first heat exchange zone to provide by indirect heat exchange a portion of the cooling of the feed gas in (a), thereby providing a first warmed refrigerant gas stream;

(6) further cooling the intermediate cooled compressed refrigerant gas stream of (3) to provide a cold compressed refrigerant gas stream, reducing the pressure of the cold compressed refrigerant gas stream to a second pressure by either work expansion or Joule-Thomson expansion across a throttling valve, wherein the second pressure is lower than the first pressure, to provide a cold reduced-pressure refrigerant gas stream;

(7) warming the cold reduced-pressure refrigerant gas stream to provide by indirect heat exchange a portion of the cooling of the further-enriched hydrogen stream of (d) in the second heat exchange zone and a portion of the cooling of the feed gas of (a) in the first heat exchange zone, thereby providing a second warmed refrigerant gas stream; and (8) compressing the first and second warmed refrigerant gas streams to provide the compressed refrigerant gas in (1).

27. The method of claim 26 wherein the refrigerant gas is selected from the group consisting of nitrogen, methane, a mixture of nitrogen and methane, and air.

* * * * *

UNITED STATES PATENT AND TRADEMARK OFFICE

CERTIFICATE OF CORRECTION

PATENT NO. : 6,560,989 B1
DATED : May 13, 2003
INVENTOR(S) : Roberts et al.

It is certified that error appears in the above-identified patent and that said Letters Patent is hereby corrected as shown below:

Column 18,
Line 51, delete “provided” and substitute therefor -- provide --.

Column 20,
Line 7, delete “provided” and substitute therefor -- provide --.

Column 21,
Line 30, delete “provided” and substitute therefor -- provide --.

Signed and Sealed this

First Day of July, 2003

JAMES E. ROGAN
*Director of the United States Patent and Trademark Office*